US006164485A

United States Patent [19]

Hilton

[11] Patent Number: 6,164,485

[45] Date of Patent: Dec. 26, 2000

[54] CONTAINER LID

[75] Inventor: Robert Nicholas Hilton, South Caulfield, Australia

[73] Assignee: Promotions Factory (Aust) PTY LTD, Prahran, Australia

[21] Appl. No.: 09/283,980

[22] Filed: Apr. 1, 1999

[30] Foreign Application Priority Data

Feb. 24, 1999 [AU] Australia ..... PP8832

[51] Int. Cl.[7] ..... A47G 19/22; B65D 1/24

[52] U.S. Cl. ..... 220/521; 220/265; 220/709; 220/713

[58] Field of Search ..... 220/521, 212, 220/703, 705, 713, 254, 319, 503, 523, 524, 526, 265, 709; 215/246, 6

[56] References Cited

U.S. PATENT DOCUMENTS

| | | | |
|---|---|---|---|
| 504,027 | 8/1893 | Fries et al. . | |
| 911,465 | 2/1909 | Weeks . | |
| 2,539,412 | 1/1951 | Faris | 220/521 X |
| 2,766,796 | 10/1956 | Tupper . | |
| 3,085,709 | 4/1963 | Klein . | |
| 3,514,029 | 5/1970 | Powell . | |
| 4,074,827 | 2/1978 | Labe, III . | |
| 4,776,972 | 10/1988 | Barrett . | |
| 4,978,022 | 12/1990 | Weick | 220/521 |
| 5,035,320 | 7/1991 | Plone . | |
| 5,088,611 | 2/1992 | Katz | 215/246 X |
| 5,117,995 | 6/1992 | Kau . | |
| 5,180,079 | 1/1993 | Jeng | 220/705 |
| 5,224,646 | 7/1993 | Biancosino | 220/521 X |
| 5,529,179 | 6/1996 | Hanson . | |
| 5,547,109 | 8/1996 | Robbins, III . | |
| 5,722,558 | 3/1998 | Thompson | 220/521 |
| 5,971,195 | 10/1999 | Reidinger et al. | 220/521 |

*Primary Examiner*—Allan N. Shoap
*Assistant Examiner*—Niki M. Eloshway
*Attorney, Agent, or Firm*—Larson & Taylor, PLC

[57] ABSTRACT

A container lid (10) including a base (11) having a rim (13) adapted to fit onto a container, a raised section projecting above the rim, the raised section including an inverted recess (15), a domed cover (12) attached to the raised section (14) above the recess to create a compartment (24) within and of substantially the same depth as the container lid, and releasable sealing means between the cover and the raised section to provide access to the compartment.

6 Claims, 6 Drawing Sheets

CONTAINER LID

FIELD OF THE INVENTION

The present invention relates to a container lid adapted for use on containers and in particular beverage cups.

BACKGROUND OF INVENTION

Plastic lids are used on disposable drink cups to prevent liquid spilling from the cups. This is particularly useful when beverages are taken away from the point of sale to be drunk elsewhere, for instance at cinemas, take-away coffee shops and sporting events. Such beverages include tea, coffee, soft drinks, soups or the like. The lid is generally the size of the opening of the cup to which it is to be fitted and has a rim which fits over the cup rim to secure the lid to the cup. Lids often include straw openings through which drinking straws can be inserted to access the beverage.

This invention relates to an improvement in this type of lid.

SUMMARY OF THE INVENTION

According to the present invention there is provided a container lid including a base having a rim adapted to fit onto a container, a raised section projecting above the rim, the raised section including an inverted recess, a domed cover attached to the raised section above the recess to create a compartment within and of substantially the same depth as the container lid, and releasable sealing means between the cover and the raised section to provide access to the compartment.

BRIEF DESCRIPTION OF THE DRAWINGS

Embodiments, incorporating all aspects of the invention, will now be described by way of example only with reference to the accompanying drawings in which.

DETAILED DESCRIPTION OF PREFERRED EMBODIMENT

Figure 1:
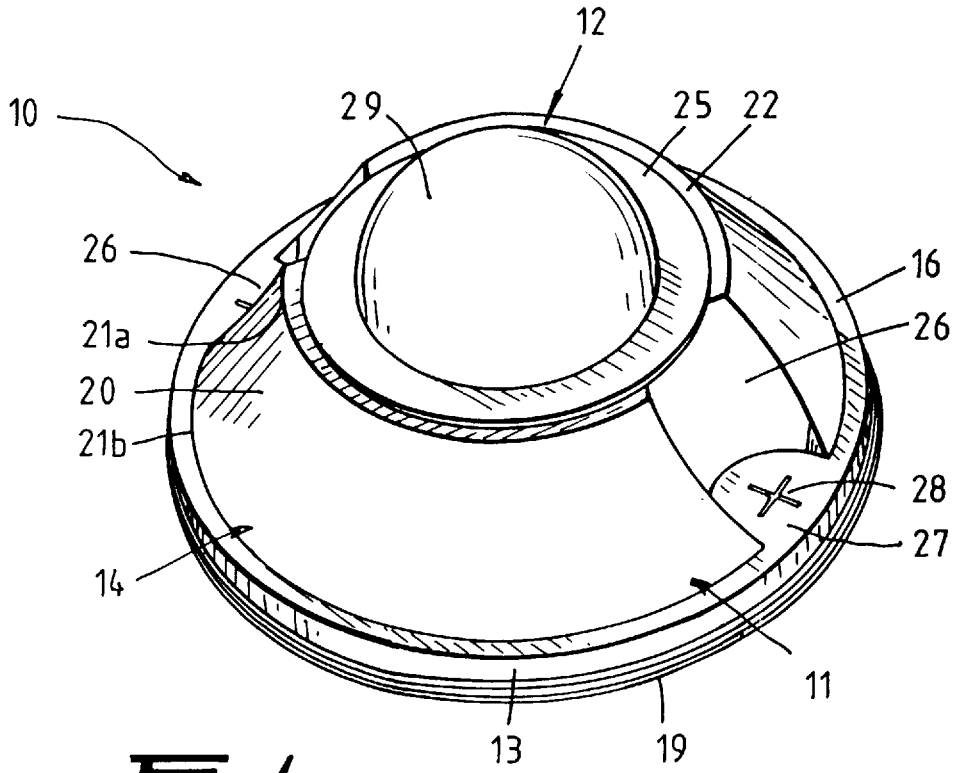
FIG. 1 is a perspective view of the upperside of a lid according to a first embodiment of the present invention.
Figure 2:
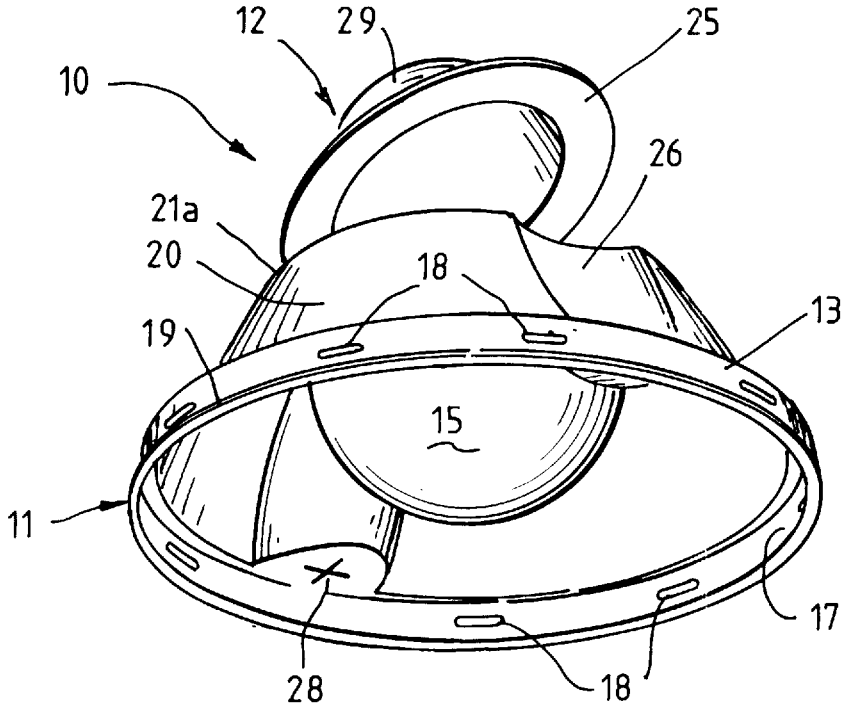
FIG. 2 is a perspective view of the underside of the lid of FIG. 1.

As illustrated in FIGS. 1 and 2 a container lid 10 comprises an annular base 11 which is adapted to fit onto a container such as a plastics drinks cup, and a domed cover 12 which is removably attached to the base 11. The base 11 includes a rim 13 defining the diameter of the lid, a frusto conical raised section 14 projecting from a location close to or on the rim 13. An inverted dome shaped recess 15 is located in the centre of the raised section 14. The domed cover 12 when attached to the base is positioned above the inverted dome 15 thus creating a spherical compartment 24 into which contents such as food or novelty items can be placed. In use, the entire lid 10 can be fitted onto a container such as a paper or plastics beverage cup. To remove the contents from the lid the cover 12 is removed from the base to provide access to the compartment.

Figure 3:
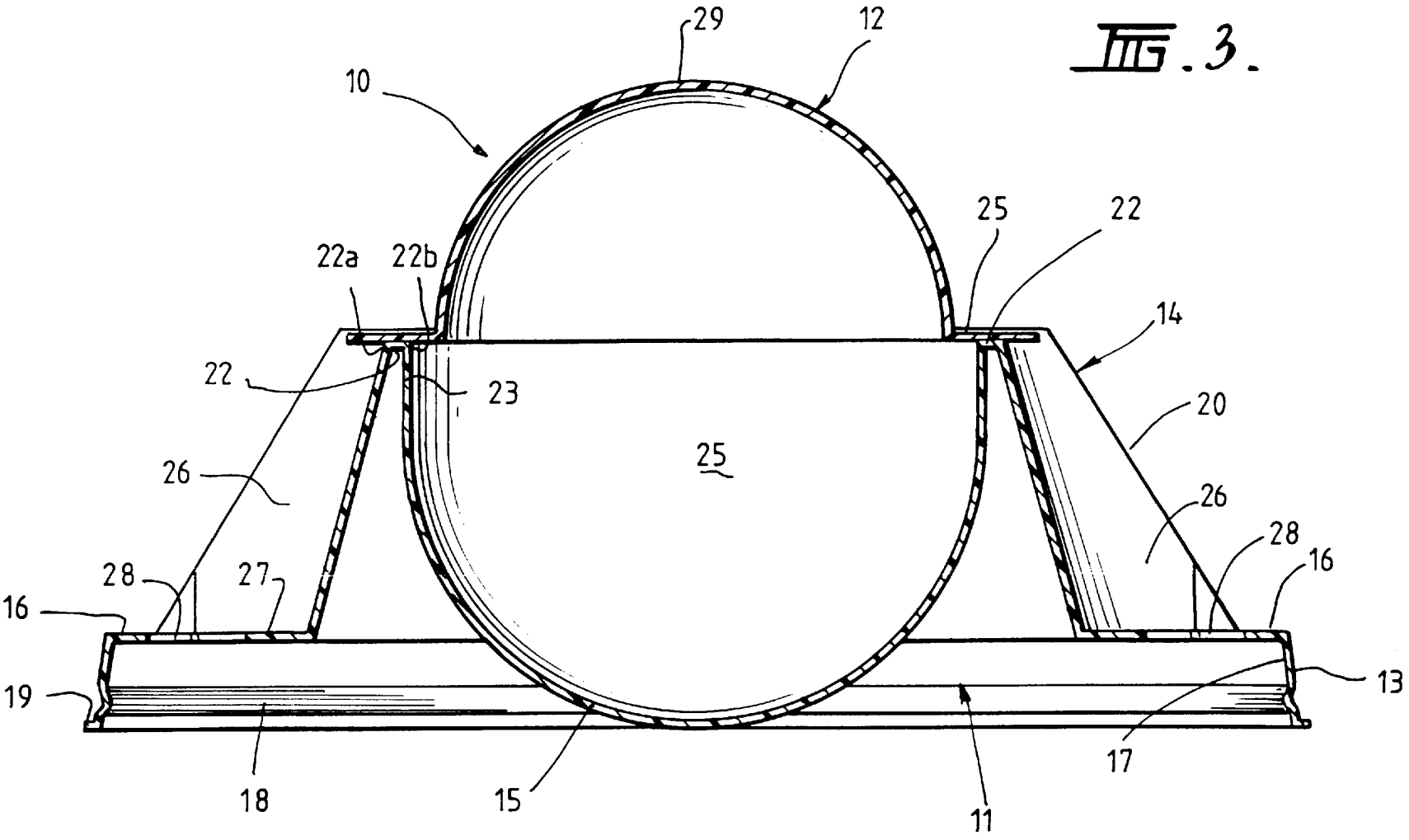
FIG. 3 is a cross sectional view of the lid of FIG. 1.
Figure 4:
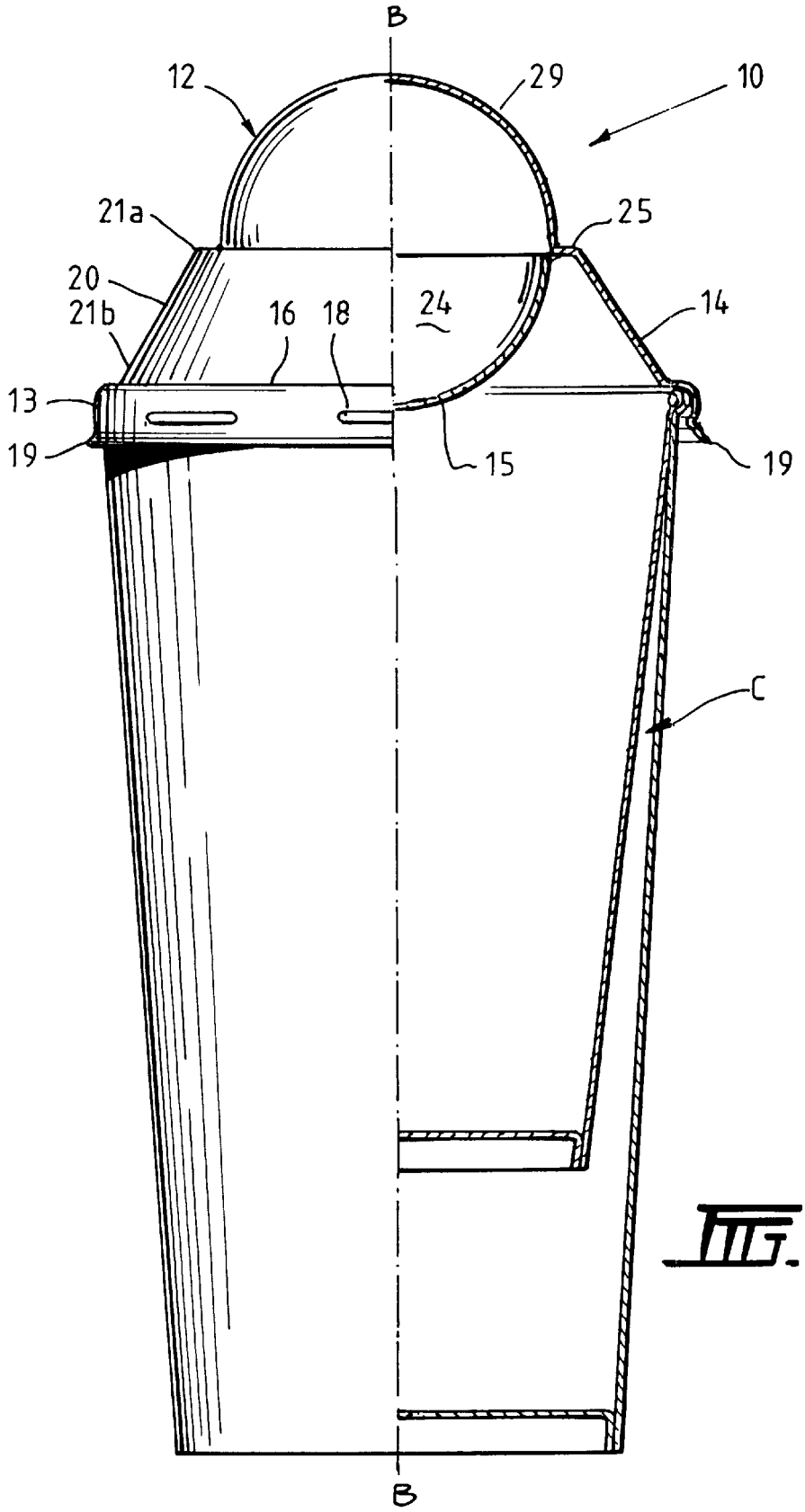
FIG. 4 illustrates the lid of FIG. 1 fitted onto two cups of different sizes wherein the left side of the central line B—B is an external view while the right side is a sectional view.

Rim 13 defines the annular shape of the lid 10 and is slightly larger in diameter compared with the diameter of a container rim on which the lid is to be 13 fitted. It is understood that the lid is manufactured in different sizes according to different cup sizes. The rim 13 depends downwardly from a horizontal ledge 16 on the periphery of the base 11 so that an inner rim wall 17 contacts the exterior container rim and container wall C (see FIG. 4). Intermittent peripheral ridges 18 on the inner rim wall 17 are designed to locate below a container rim when the lid is fitted to a container to prevent the lid unintentionally detaching from the container. FIG. 3 illustrates an embodiment wherein there is only one protruding ridge on the inner rim wall rather than multiple intermittent ridges. The lowest edge 19 of the rim curves outward so as to provide a gripping edge for users to secure the lid to and remove it from the container.

The raised section 14 is annular in shape and projects upwardly from the horizontal ledge 16 of the base close to the rim. Thus, the horizontal ledge separates the raised section 14 and the rim 13. The raised section has a tapering annular face 20 inclining towards the centre of the lid. At the upper edge 21*a* of the tapering wall (see FIG. 3) there is provided a horizontal annular shoulder 22. The tapering face meets with the outer edge 22*a* of the shoulder while the inner edge 22*b* of the shoulder meets with the edge 23 of the inverted dome 15. The inverted dome is thus disposed centrally in an area defined by the annular raised section. The nadir of the inverted dome is approximately level with the lowest edge 19 of the rim as illustrated in FIG. 3. Although the dome can be made shallow, this is undesirable as it would reduce the spherical space 24 for holding product. The dome may conversely be made deeper to maximise the spherical space 24, however care should be taken to ensure the nadir of the dome does not contact the liquid when the lid is fitted onto a container. The entire base 11 including rim 13, raised section 14 and inverted dome 15 is formed as a single component.

The cover 12 is a hemi-spherical dome 29 with a flanged annular edge 25. The flange 25 is adapted to be seated on shoulder 22. FIG. 1 illustrates an embodiment where the flange 25 of the domed cover remains radially inward of the outer edge 22*a* of the shoulder. The shoulder has a recessed groove (not shown) at the inner edge 22*b* to accommodate the seated flange. Since the inner edge is recessed the outer edge 22*b* of the shoulder is raised thus ensuring the flange, and thus the domed cover is maintained in position in the recessed groove.

In use, novelty and/or food products are placed in the inverted dome 15. The domed cover is then attached to the base by heat sealing the flange 25 to the shoulder 22. The product is meanwhile enclose in the spherical space 24 created by the domed cover 12 and the inverted dome 15. The cover can be removed by simply lifting the flange and peeling off.

Figure 5:
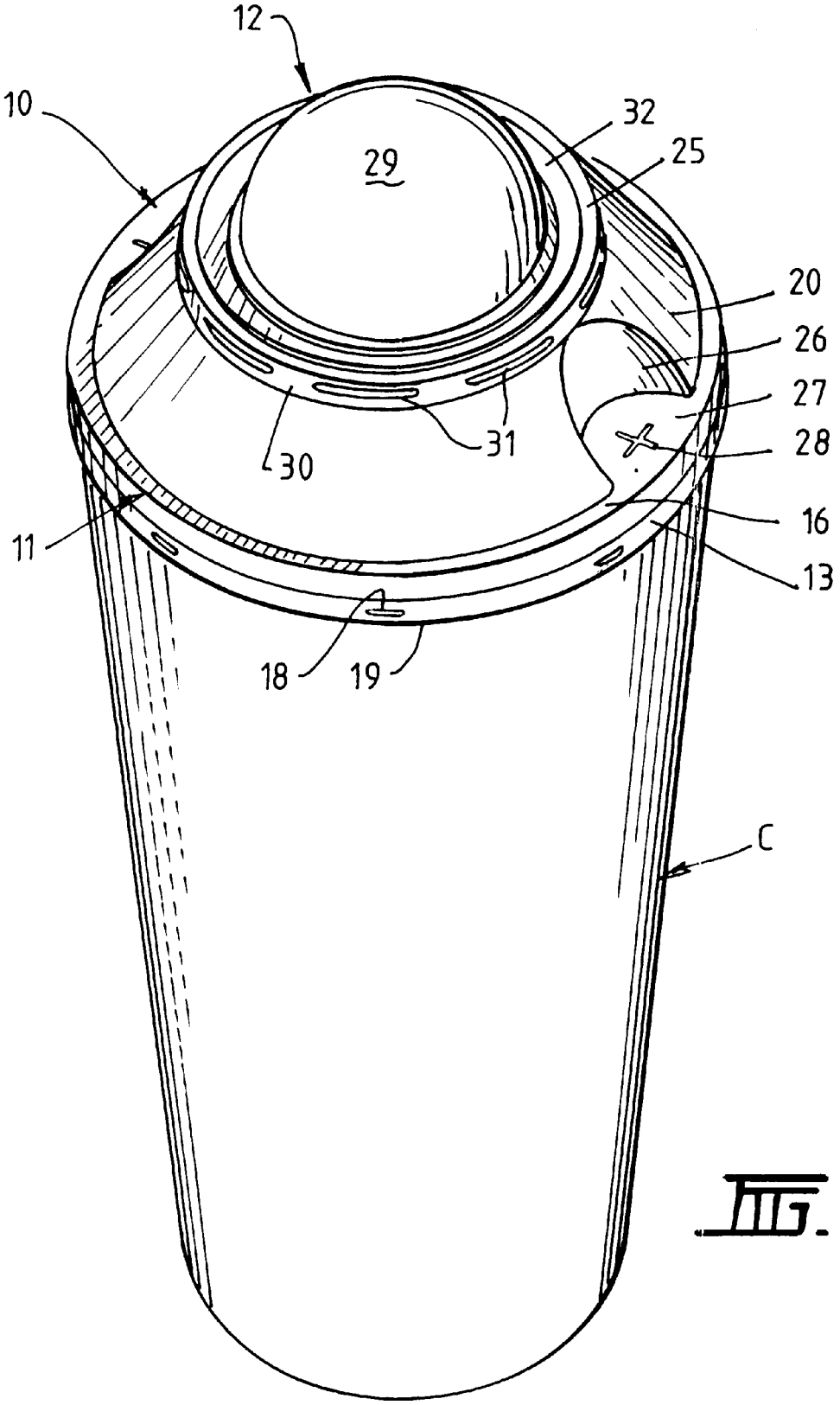
FIG. 5 is a perspective view of a lid fitted to a cup according to a second embodiment of the present invention.
Figure 6:
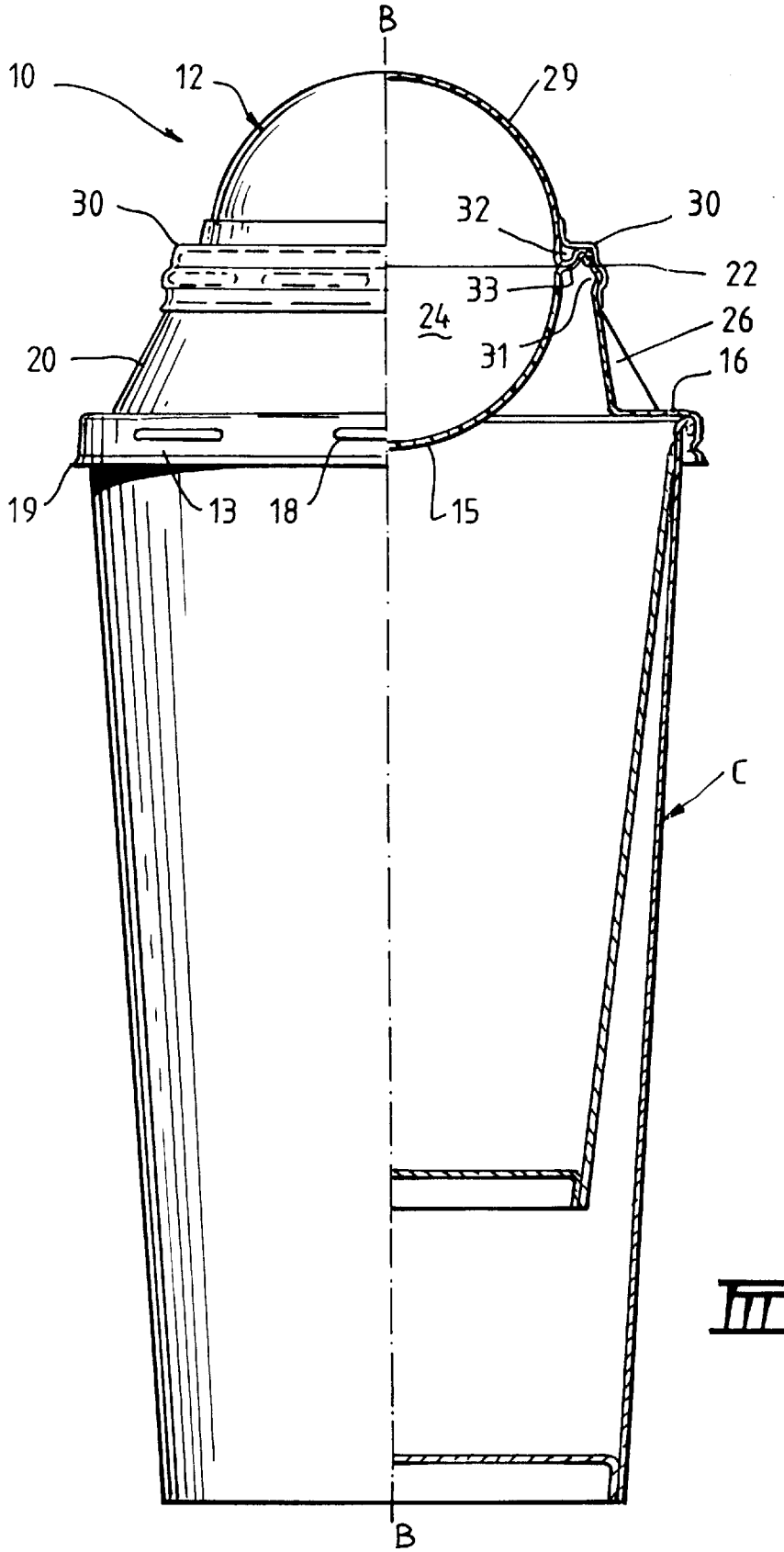
FIG. 6 illustrates the lid of FIG. 5 fitted onto two cups of different sizes wherein the left side of the central line B—B is an external view while the right side is a sectional view.
Figure 7:
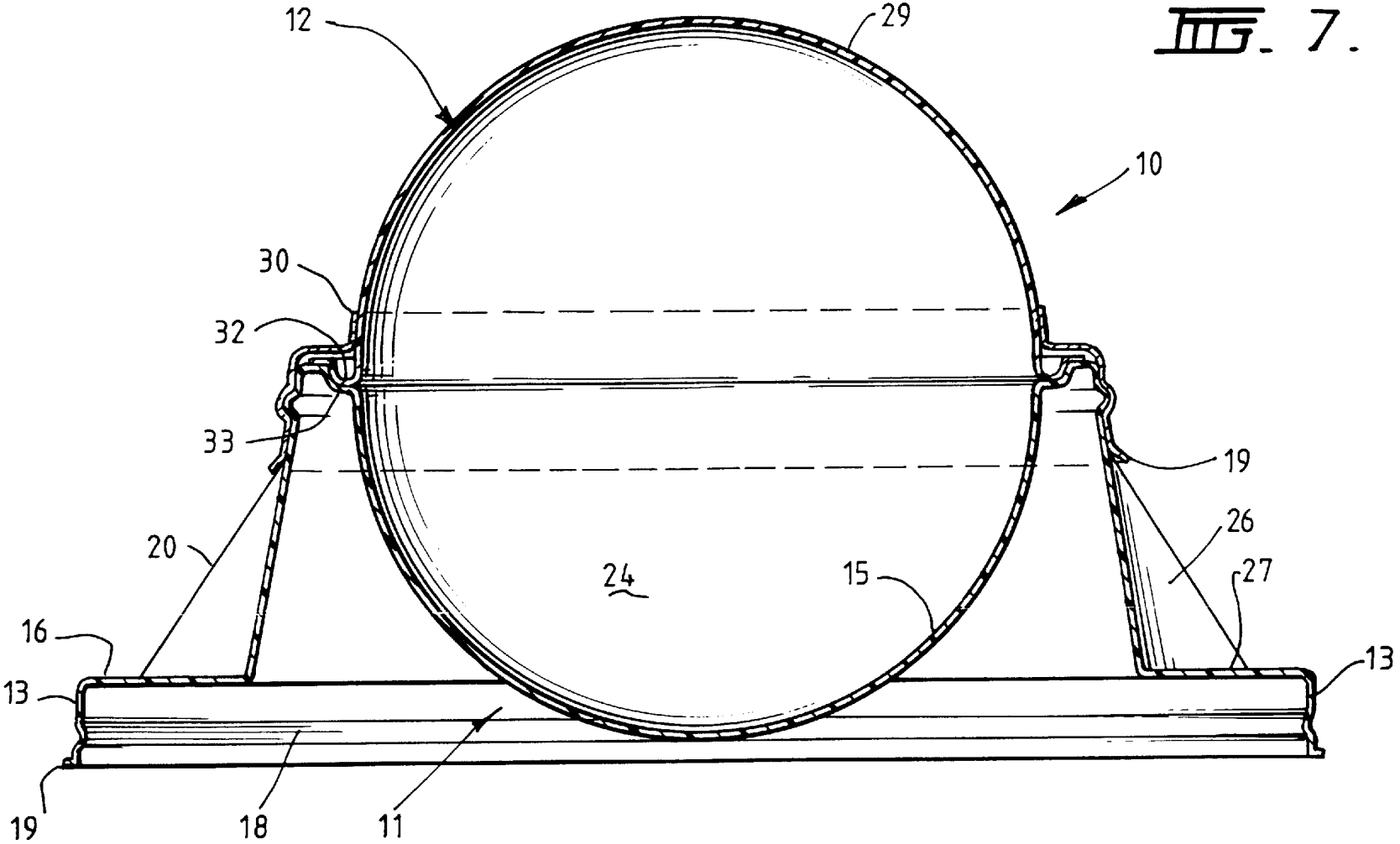
FIG. 7 is a cross sectional view of the lid of FIG. 5.

In the second embodiment of the invention as illustrated in FIGS. 5 to 7, the domed cover is shrink sealed to the raised section of the base by means of a perforated tamper evident seal 30. The seal must be removed to enable the cover to be removed and to gain access to the compartment. Towards the upper end of the tapering face 20 in this embodiment, near the upper edge 21*a,* are intermittent peripheral ridges 31 similar to the ridges 18 on the base rim 13. The ridges 31 are provided to enhance sealing contact with the tamper evident seal 30. A hot melt adhesive may also be used to improve the seal. Between dome 29 and flange 25 of the cover is an annular groove 32 which conforms with a complementary annular seat 33 in the annular shoulder 22 of the base. Thus, cover 12 is easily and accurately positioned on the base 11 before the tamper evident seal is shrink sealed to attach the components together.

The raised section 14 further has two longitudinal channels 26 extending from the upper edge 21*a* of the tapering face 20 to the lower edge 21*b* of the tapering face. The channels 26 are generally concave which results in a semi-circular flat portion 27 located inwardly of the horizontal ledge 16 of the base 11. The two channels are located at opposite sides of the raised section 14. The function of the channels is twofold. Firstly, the radial width of the shoulder at the longitudinal channels 26 is reduced so that the flange 25 of the domed cover 12 overhangs the raised section. This provides users with a finger hold with which to lift and peel the domed cover off the base. Secondly, straw openings 28 are provided in the flat semi-circular portions 27 on the base. The openings are a conventional slitted cross, with the straw being pushed through the centre of the cross to access the beverage.

The annular base 11 and the domed cover 12 are thermoformed in high impact styrene and their outer diameters are die cut. The cover protects the contents of the spherical space from spilled beverage and other environmental factors.

Although in the preferred embodiments the cover 12 is heat sealed or shrink sealed to the base 11 it is understood that other means of attachment are also envisaged such as a tangible connection or a hinged join with a catering device.

It will be understood to persons skilled in the art of the invention that many modifications may be made without departing from the spirit and scope of the invention.

Having described my invention what I claim is:

1. A container lid assembly comprising a base having a rim adapted to fit onto a container, a raised section projecting above the rim, the raised section including a recess, a cover with a raised top, the cover being attached to the raised section above the recess so that the raised top of the cover and the recess cooperate to create a compartment within, and of substantially the same depth as, the container lid assembly, and releasable sealing means between the cover and the raised section for providing access to the compartment, the compartment being spherical and being positioned centrally of the lid assembly.

2. The container lid assembly according to claim 1 wherein the sealing means comprises a tear-off seal positioned between the cover and the raised section.

3. The container lid assembly according to claim 1 wherein the sealing means comprises a shrink-on annular seal that fits on the joint between the cover and the raised section, the seal being capable of being torn off to release the cover.

4. The container lid assembly according to claim 1 wherein the base and cover are molded in plastic.

5. The container lid assembly according to claim 1 wherein the raised section has a frusto-conical wall portion.

6. The container lid assembly according to claim 5 wherein the frusto-conical wall portion is provided with an arcuate cut-out that terminates in a planar ledge at the base of the raised section, the ledge being adapted to facilitate entry of a drinking straw.

* * * * *